US010508496B2

(12) United States Patent
Kutinsky et al.

(10) Patent No.: US 10,508,496 B2
(45) Date of Patent: Dec. 17, 2019

(54) DOWNHOLE VIBRATION TOOL

(71) Applicants: David P. Kutinsky, Edmonton (CA); Donald James Sheen, Leduc (CA); Darren William Sallis, Leduc (CA)

(72) Inventors: David P. Kutinsky, Edmonton (CA); Donald James Sheen, Leduc (CA); Darren William Sallis, Leduc (CA)

(73) Assignee: DIRECTIONAL VIBRATION SYSTEMS INC., Edmonton, Alberta (CA)

( * ) Notice: Subject to any disclaimer, the term of this patent is extended or adjusted under 35 U.S.C. 154(b) by 0 days.

(21) Appl. No.: 15/841,609

(22) Filed: Dec. 14, 2017

(65) Prior Publication Data

US 2018/0163479 A1 Jun. 14, 2018

Related U.S. Application Data

(60) Provisional application No. 62/434,101, filed on Dec. 14, 2016.

(51) Int. Cl.

| | |
|---|---|
| ***E21B 28/00*** | (2006.01) |
| ***E21B 7/24*** | (2006.01) |
| ***E21B 4/02*** | (2006.01) |
| ***E21B 34/06*** | (2006.01) |
| ***E21B 21/10*** | (2006.01) |
| ***E21B 31/00*** | (2006.01) |

(52) U.S. Cl.

CPC ..... *E21B 7/24* (2013.01); *E21B 4/02* (2013.01); *E21B 21/10* (2013.01); *E21B 28/00* (2013.01); *E21B 31/005* (2013.01); *E21B 34/06* (2013.01)

(58) Field of Classification Search

CPC ..... E21B 47/0007; E21B 43/128; E21B 28/00

See application file for complete search history.

(56) References Cited

U.S. PATENT DOCUMENTS 4,785,300 A 11/1988 Chin et al.
4,819,745 A * 4/1989 Walter ..... E21B 7/18 175/107
4,830,122 A 5/1989 Walter
(Continued)

FOREIGN PATENT DOCUMENTS

EP 0535815 A1 9/1992

OTHER PUBLICATIONS

CN-107100584-A—abstract and 1 Figure. (Year: 2017).*

*Primary Examiner* — Zakiya W Bates
(74) *Attorney, Agent, or Firm* — Davis & Bujold PLLC; Michael J. Bujold

(57) ABSTRACT

A downhole vibration tool that permits tool retrieval therethrough has an outer housing with an inner bore and a longitudinal axis, a rotating impeller that rotates within the inner bore of the outer housing, the rotating impeller defining an outer flow passage and an inner flow passage nested within the outer flow passage. The rotating impeller carries impeller vanes that are angled relative to a rotational axis and that extend into the outer flow passage such that fluid passing through the outer flow passage impinges on the impeller vanes to cause the rotating impeller to rotate. A flow restrictor having a variable flow area is positioned in the outer flow passage adjacent to the impeller vanes, and the rotation of the impeller vanes causes the flow area of the flow restrictor to periodically increase and decrease.

20 Claims, 8 Drawing Sheets

(56) References Cited

U.S. PATENT DOCUMENTS

| | | | | |
|---|---|---|---|---|
| 4,914,637 | A | 4/1990 | Goodsman | |
| 5,119,344 | A | 6/1992 | Innes | |
| 5,586,083 | A | 12/1996 | Chin et al. | |
| 5,636,178 | A | 6/1997 | Ritter | |
| 5,787,052 | A | 7/1998 | Gardner et al. | |
| 6,279,670 | B1 | 8/2001 | Eddison et al. | |
| 6,970,398 | B2 | 11/2005 | Lavrut et al. | |
| 9,382,760 | B2 | 7/2016 | Le et al. | |
| 9,598,923 | B2 | 3/2017 | Gilleylen et al. | |
| 2006/0034154 | A1 | 2/2006 | Perry et al. | |
| 2006/0118334 | A1 | 6/2006 | Hahn et al. | |
| 2007/0182583 | A1 | 8/2007 | Feluch | |
| 2007/0196205 | A1 | 8/2007 | Moriarty | |
| 2012/0193145 | A1 | 8/2012 | Anderson | |
| 2016/0194917 | A1* | 7/2016 | Alali | E21B 7/24 175/322 |

* cited by examiner

DOWNHOLE VIBRATION TOOL

TECHNICAL FIELD

This relates to a vibration tool for a downhole tubing string.

BACKGROUND

When working downhole, such as during a drilling operation, it is common to provide a vibration tool that induces vibrations in the tubing string to reduce the friction of the tool and to reduce the likelihood of the tubing string from becoming stuck.

Vibration tools may take various forms. One common type of tool uses a rotating eccentric mass to generate vibrations. Another common type involves a valve or restriction that opens and closes to generate pressure pulses to generate vibrations. An example of a downhole vibration tool can be found in U.S. Pat. No. 6,279,670 (Eddison et al.) entitled "Downhole flow pulsing tool".

SUMMARY

According to an aspect, there is provided a downhole vibration tool that permits tool retrieval therethrough, the downhole vibration tool comprising an outer housing having an inner bore and a longitudinal axis, a rotating impeller that rotates within the inner bore of the outer housing, the rotating impeller defining an outer flow passage and an inner flow passage nested within the outer flow passage, the rotating impeller carrying impeller vanes that are angled relative to a rotational axis and that extend into the outer flow passage such that fluid passing through the outer flow passage impinges on the impeller vanes to cause the rotating impeller to rotate, and a flow restrictor having a variable flow area positioned in the outer flow passage and adjacent to the impeller vanes, the rotation of the impeller vanes causing the flow area of the flow restrictor to periodically increase and decrease.

According to other aspects, the downhole vibration tool may further comprise a flow diverter having one or more flow restrictions in fluid communication with the inner flow passage and an outer surface in fluid communication with the outer flow passage, the flow diverter being removably mounted to cover the inner bore of the outer housing, the flow restrictor may comprise a series of flow stops and openings that are radially distributed through the outer flow passage and immediately adjacent to the rotating impeller, and the impeller vanes may define radially distributed rotating openings about the rotating impeller, and wherein the flow area may increases and decreases as the rotating openings rotate across the openings of the flow restrictor, the impeller vanes may have a thickness in the radial direction and the flow stops of the flow restrictor may have a thickness in the radial direction between openings, and the variable flow area of the flow restrictor may be is varied as the thickness of the impeller vanes passes over the openings of the flow restrictor, the flow restrictor may comprise a stationary impeller having stationary impeller vanes, and the flow stops may comprise a radial thickness of the stationary impeller vanes and the openings may be formed between adjacent stationary impeller vanes, the impeller vanes may extend out from the rotating impeller toward the outer housing, the flow diverter may be mounted to the rotating impeller, the first end of the inner flow passage may be opened by removing the flow diverter to allow the inner flow passage to act as a tool retrieval passage, the rotating impeller may comprise a tubular body having an outer surface, and an inner surface that defines the inner flow passage, the outer flow passage may be in fluid communication with the inner flow downstream of the flow restrictor, the rotating impeller may be upstream of the flow restrictor, and may further comprise a flow conditioner upstream of the rotating impeller, the flow conditioner comprising conditioning vanes that are angled in a rotational direction opposite the rotating impeller vanes to increase an angle of incidence of the fluid against the rotating impeller vanes, and the angle of at least one of the conditioning vanes and the rotating impeller vanes may be a composite angle.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
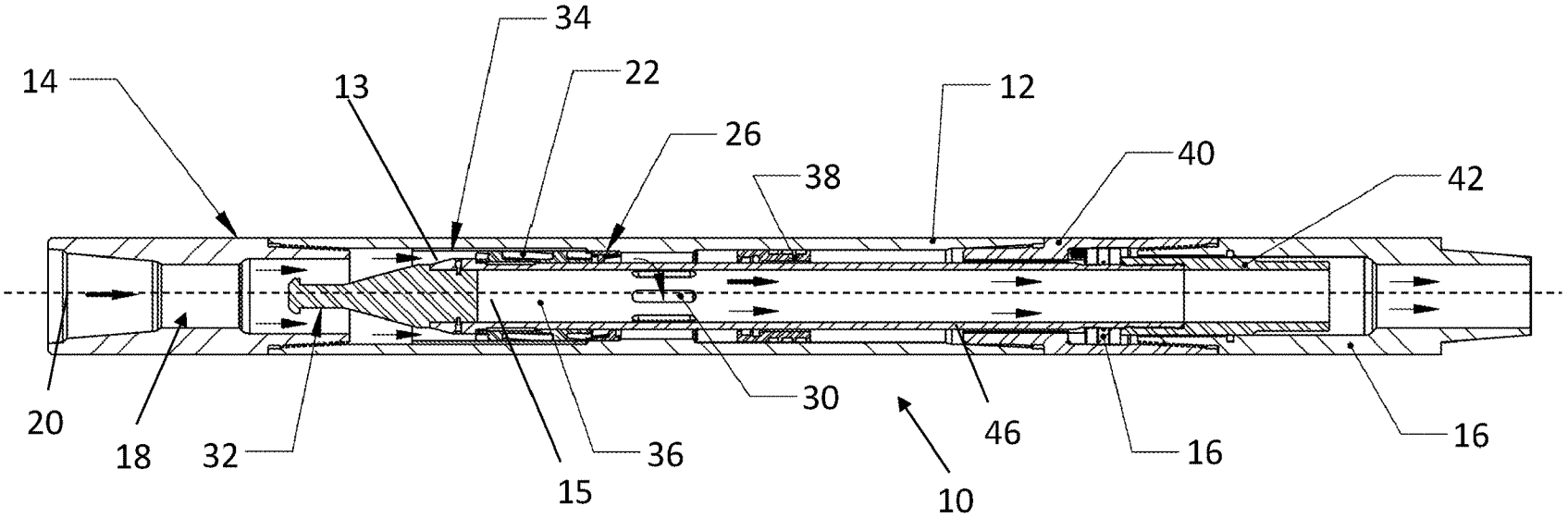
FIG. 1 is a side elevation view in section of a downhole vibration tool.

Referring to FIG. 1, there is shown a downhole vibration tool, referred to generally by reference number 10, which permits tool retrieval therethrough. The tool 10 has an outer housing 12, also known as an impeller housing, which is designed to be connected to a tubing string (not shown) using a top sub 14, and a bottom sub 16. While these are commonly used connections, other connections may also be used depending on the situation. The outer housing 12 has an inner surface that defines an inner bore 18, and a longitudinal axis 20 that extends along the outer housing 12.

Figure 2A:
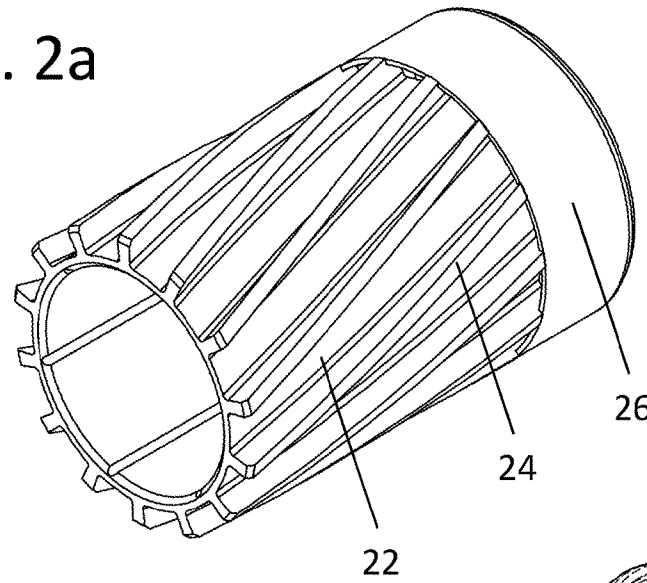
FIG. 2*a* is a perspective view of the impellers of the downhole vibration tool of FIG. 1.

The depicted vibration tool 10 is designed to generate pulses as the flow area through the outer housing 12 changes by rotating a rotating impeller 22 within the inner bore 18 of the outer housing 12. The rotating impeller defines an outer flow passage 13 and an inner flow passage 15 nested within the outer flow passage 13. Referring to FIG. 2, the rotating impeller 22 is shown having curved, angled vanes 24 on an exterior surface of a tubular body having an outer surface and an inner surface that defines inner flow passage 15. The tubular body may act as an inner sleeve, with angled vanes 24 of rotating impeller 22 extending out toward outer housing 12 into the outer flow passage 13, and that rotate with the rotating impeller 22. The vanes 24 are angled relative to a rotational axis, and fluid passing through the outer flow passage 13 impinges on impeller blades 24 to cause rotating impeller 22 to rotate. While it may be possible to have vanes 24 that extend inward, it is felt that this would increase the complexity of the design. In either case, the vanes 24 would still be required to extend into the outer flow passage 13 such that fluid passing through the outer flow passage 13 causes the impeller vanes 24 to apply a rotational force to the rotating impeller 22.

Referring to FIG. 2, a flow restrictor 26 is positioned below the rotating impeller 22. Flow restrictor 26 provides a variable flow area in the outer flow passage adjacent to impeller vanes 24. Flow restrictor 26 may have a series of flow stops and openings that are radially distributed through outer flow passage 13 and are positioned immediately adjacent to rotating impeller 22. Flow restrictor 26 may be considered a fixed impeller with impeller vanes 28 that act as flow stops to define radially distributed rotating openings about rotating impeller 22. In this manner, the flow area may increase and decrease as the rotating openings rotate across the openings of flow restrictor 26. in the depicted example, the flow area varies based on the thickness of the impeller vanes 24 in the radial direction relative to the thickness of the flow stops 28 between openings of flow restrictor 26 in the radial direction. As flow restrictor 26 is immediately adjacent to rotating impeller 22, the relative position of the openings of each controls the flow area through outer flow passage 13.

Figure 2C:
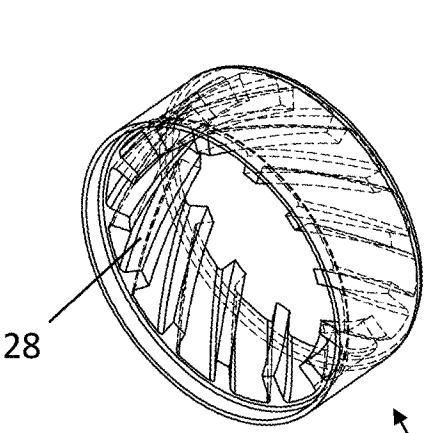
FIG. 2*c* is a perspective view of a fixed impeller.
Figure 2B:
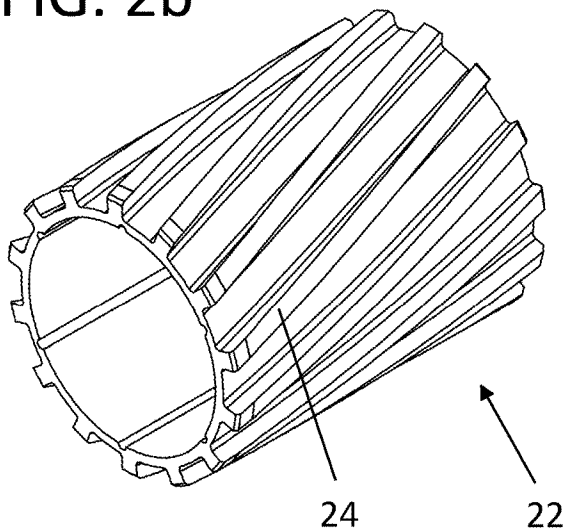
FIG. 2*b* is a perspective view of the rotating impeller
Figure 3A:
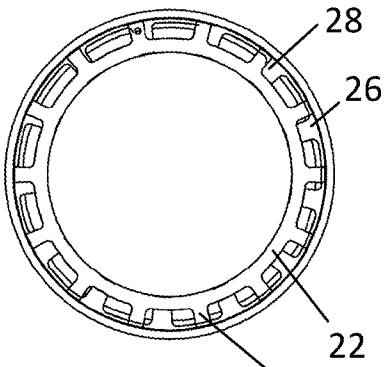
FIG. 3*a* through 3*h* are cross-sectional views of the impeller section of the downhole vibration tool of FIG. 1 as the impellers rotate.
Figure 3B:
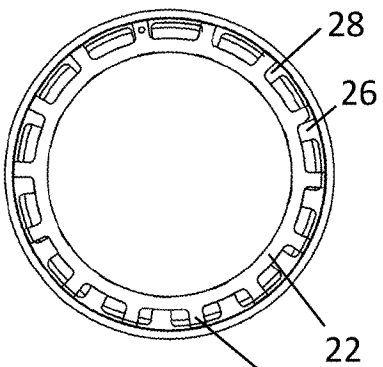
Figure 3C:
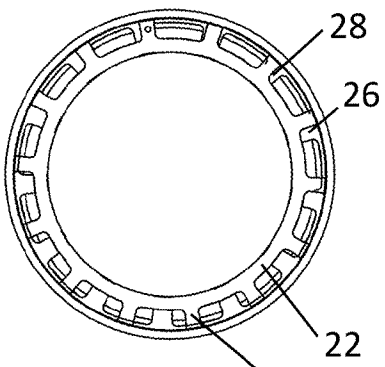
Figure 3D:
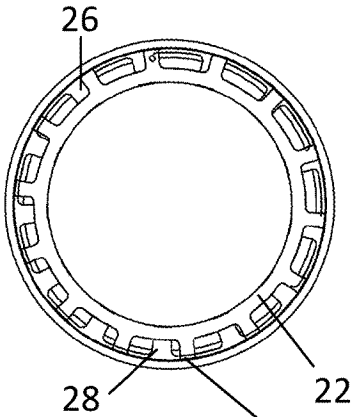
Figure 3E:
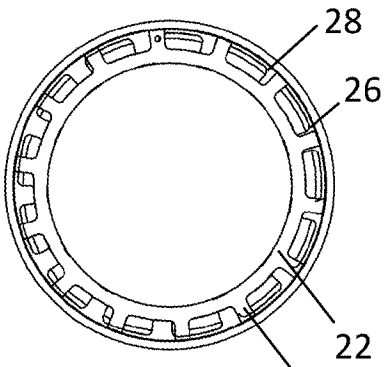
Figure 3F:
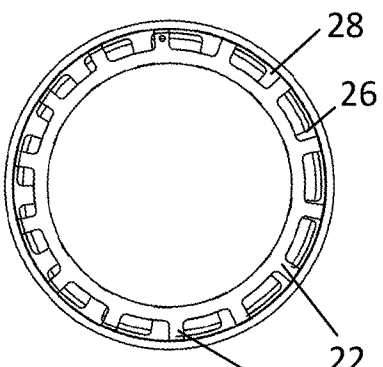
Figure 3G:
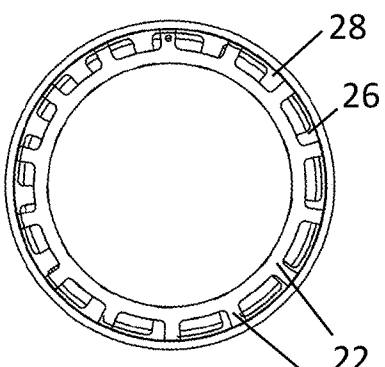
Figure 3H:
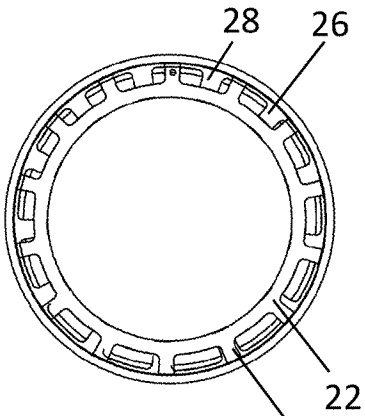
Figure 5:
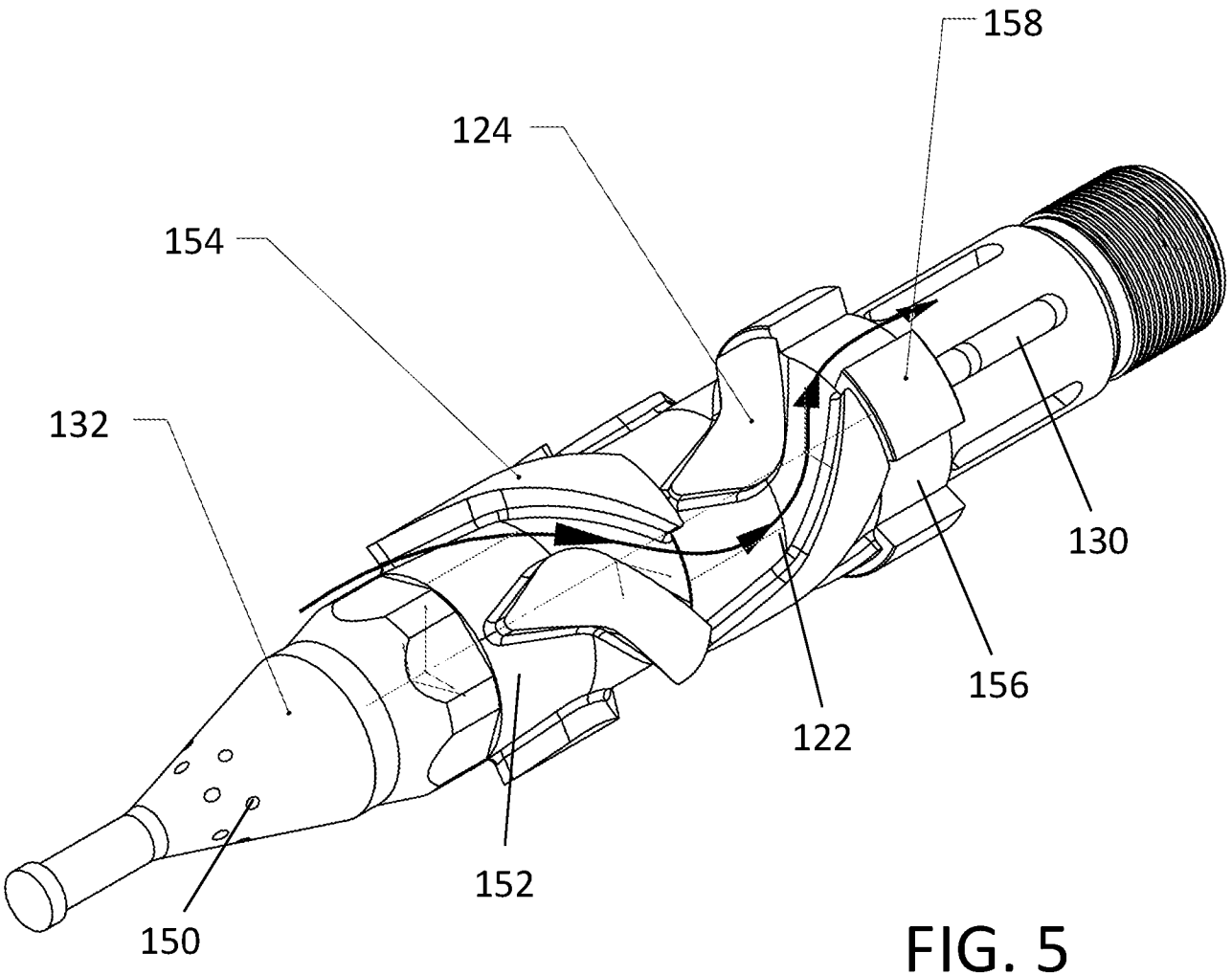
FIG. 5 is a perspective view of the flow diverter and impeller section of the downhole vibration tool of FIG. 4 in a first position.

In the example depicted in FIG. 2*c*, the flow restrictor 26 acts as a stationary impeller and has stationary impeller vanes 28. The flow stops are formed by the radial thickness of stationary impeller vanes 28, and the openings are formed between adjacent stationary impeller vanes 28. Impeller vanes 28 are preferably angled relative to the longitudinal axis 20 of the outer housing 12, and are stationary relative to the outer housing 12 as shown in FIG. 1. Alternatively, the vanes may be parallel to the axis of the tool, as is shown in FIG. 5. In the depicted example, the stationary impeller vanes 28 extend into the outer flow passage 13 toward the outer housing 12 at a point downstream of the impeller vanes 24, although the rotating and stationary impellers 22 and 26 may be changed, such that the stationary impeller 26 is upstream of the rotating impeller 22. Each of the impeller vanes 24 and the stationary impeller vanes 28 are spaced apart around the respective rotating and stationary impellers 22 and 26, and also have a thickness when taken in cross-section. A shown in FIG. 3*a*-3*h*, as the thickness of the impeller vanes 24 passes over the spacing between the stationary impeller vanes 28, the flow area of the flow restrictor 26 is varied. This causes the flow area to increase and decrease periodically, causing the pressure within the tubing string to increase and decrease accordingly. The pressure pulses that are generated in this manner will depend primarily on: the frequency with which the rotating impeller 22 rotates; the angle, thickness, and spacing of the vanes 24 and 28 on the rotating and stationary impellers 22 and 26, respectively, and the cross-sectional area of the flow passage, both in absolute terms and relative to the flow area of the tubing string. FIG. 3*a* through FIG. 3*h* shows a series of cross-sectional views depicting the degree to which the flow area through the tool may vary using the depicted design as the rotating impeller 22 rotates relative to the stationary impeller 26.

As shown, the stationary impeller 26 has vanes 28 that are at an angle relative to the longitudinal axis 20 of the housing 12. As fluid flows through the rotating impeller 22, causing it to rotate, the fluid exits and strikes the vanes of the stationary impeller 26. The angled vanes 28 may be provided to increase the back pressure of the fluid flowing through the vibration tool 10.

Outer flow passage 13 may be in fluid communication with inner flow passage 15 downstream of flow restrictor 26. This may, for example, be achieved by providing the tubular body with one or more openings 30 downstream of the flow restrictor that communicate fluid from the outer flow passage 13 to the inner flow passage 15. As shown, the flow openings 30 are in a portion of the tubular body that rotates with the rotating impeller 22, however other designs may also be possible. As will be understood, the inner flow passage 15 is designed to allow the flow to return to a full-bore flow through the tool 10.

Referring to FIG. 1, the inner and outer flow passages 15, 13 may be defined and separated by a flow diverter 32. Flow diverter 32 has one or more flow restrictions (not shown) in fluid communication with inner flow passage 15 and an outer surface in fluid communication with outer flow passage 13. The flow area of the flow restrictions may be modified to control the relative amount of fluid flow and pressure in the outer flow path 13, and therefore the intensity of vibrations produced. Flow diverter 32 may also be used as a retrieving tool, and is positioned upstream of the rotating impeller 22 that diverts fluid flowing through the inner bore 18 of the outer housing 12 into the outer flow passage 13. The flow diverter 32 blocks a first end of the inner flow passage 15, and may be removably mounted to cover the inner bore 18 of the outer housing 12. Preferably, and as shown, the flow diverter 32 is mounted to the rotating impeller 22, or it may be fixed upstream of rotating impeller 22 in another manner. The flow diverter 32 has a fishable neck on the upstream end, and is connected by shear screws that release when a sufficient upward force is applied. The flow diverter 32 can then be removed to open the inner flow passage 15, allowing inner flow passage 15 to act as a tool retrieval passage.

Referring to FIG. 1, downhole vibration tool 10 may also be provided with a bearing sleeve 34 on the inner surface of outer housing 12, within which rotating impeller 22 rotates. Rotating impeller 22 and stationary impeller 26 may be mounted over impeller mandrel 36. Downstream from openings 30, vibration tool 10 may also be provided with a balance piston 38. Outer housing 12 may be attached to adapter housing 40, which may connect between outer housing 12 and the inner portion 46 as shown. A retaining nut 42 may be placed between bottom sub 16 and inner portion 46, with a thrust bearing 44 placed in a cavity formed between adaptor housing 40, inner portion 46, retaining nut 42, and bottom sub 16.

In one example, the tool 10 is placed in a drill string, at a predetermined location, above a bottom hole assembly. A bottom hole assembly may contain a tool known in the industry as an MWD (Measurement While Drilling) tool, which are very expensive. As these tools are expensive, it is desirable to be able to send a fishing (retrieval) line to retrieve these tools if the drill string becomes stuck.

During operation, mud is pumped from surface through the drill string. As the mud enters the vibration tool 10, it is deflected by the retrieving tool 32 to pass through the impellers 22, 26. The inner impeller 22 is keyed to the impeller shaft and the outer stationary impeller 26 is locked in the impeller housing. As the mud passes through the vanes 24 of the internal impeller 22 it causes the internal impeller 22 to rotate. As the blades 24 of the impeller 22 pass one another it opens and closes vane cavities to generate a pressure increase and decrease as the vane cavities pass one another. After the mud passes through the impeller assembly it will enter back into the internal bore 18 of the tool to continue down the drill string. If the need to retrieve tools further down the drill string arises, a retrieving mechanism is dropped down through the bore of the drill string to attach to the retrieving tool 10. With tension applied, shear screws will shear and release the retrieving tool 32 and allow it to be pulled to the surface. With the bore 18 open, a fishing line can be sent down the drill string and pass freely through the vibration tool 10 to retrieve any tools further down the drill string.

Figure 4:
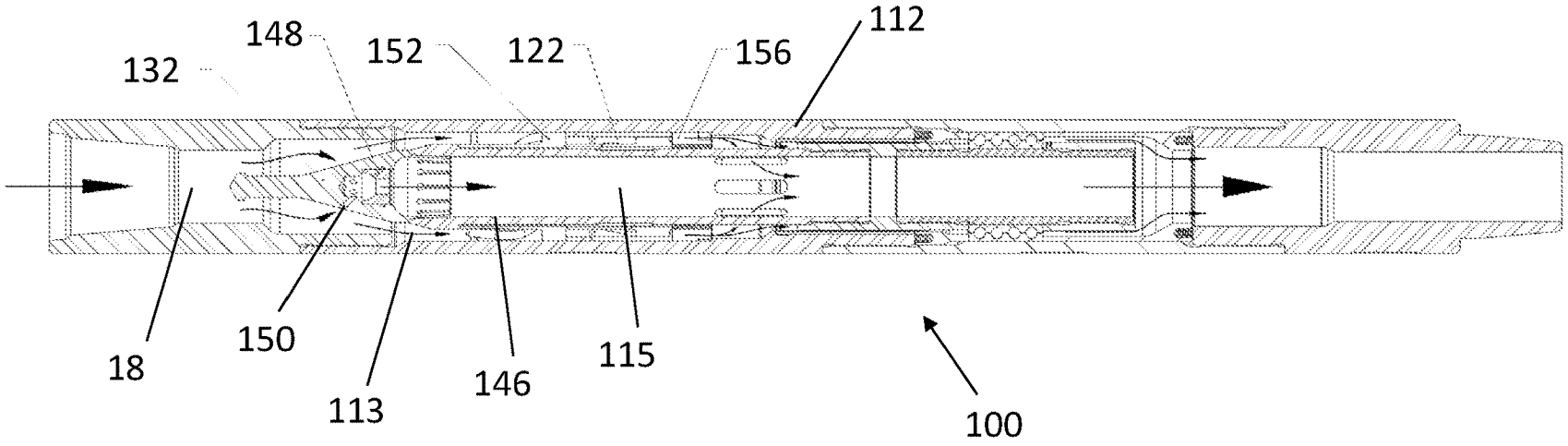
FIG. 4 is a side elevation view in section of an alternate embodiment of a downhole vibration tool.
Figure 6:
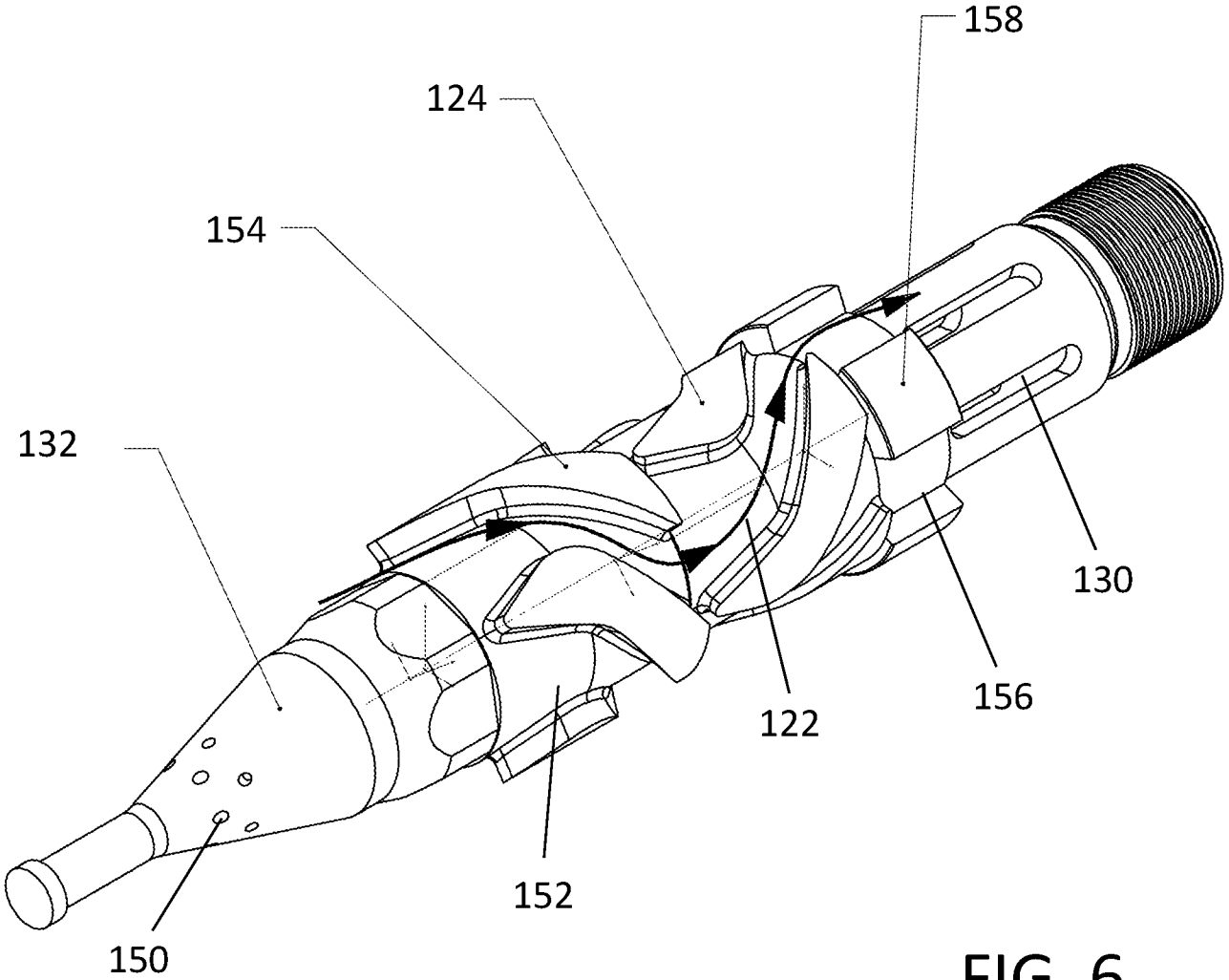
FIG. 6 is a perspective view of the flow diverter and impeller section of the downhole vibration tool of FIG. 4 in a second position.
Figure 7:
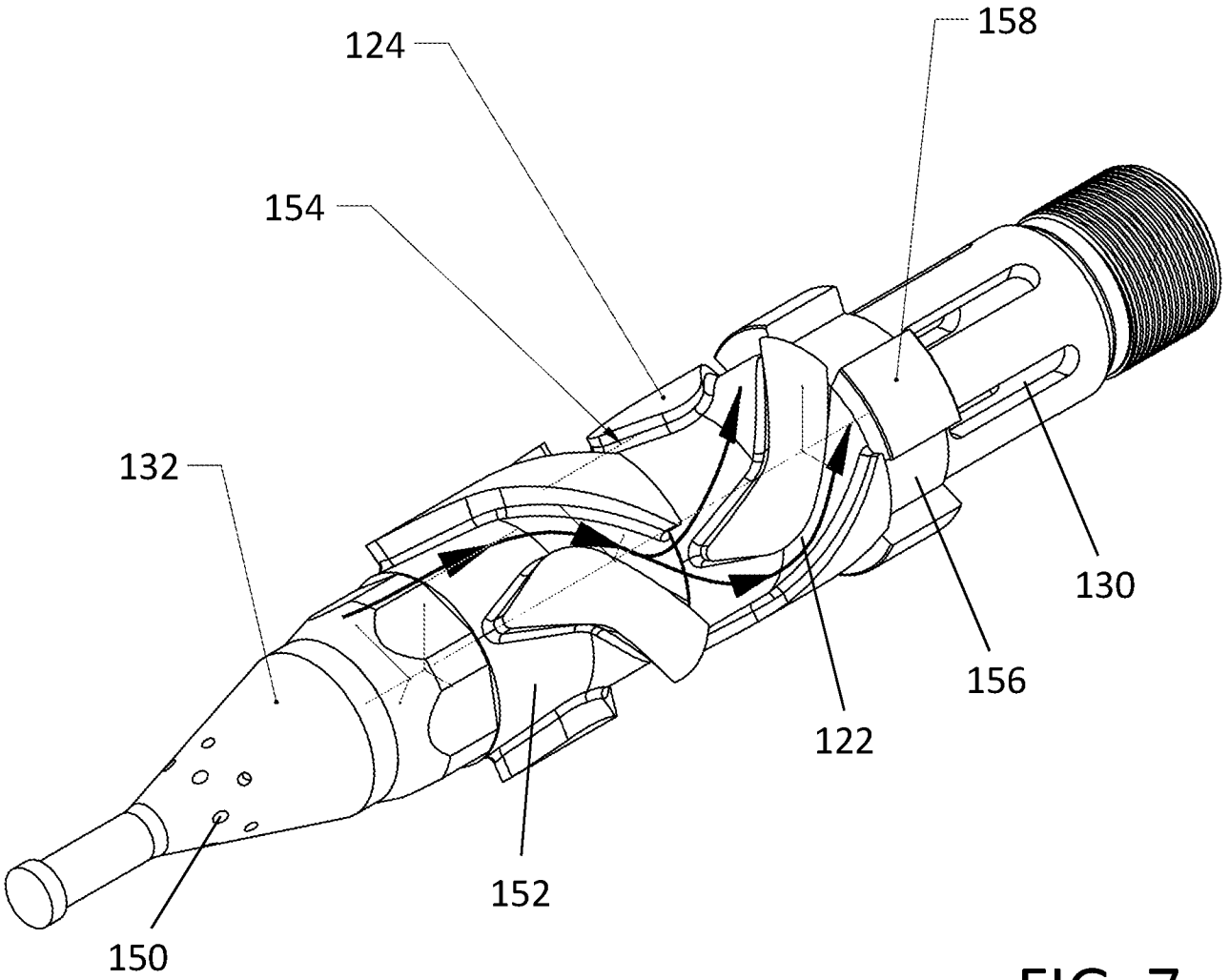
FIG. 7 is a perspective view of the flow diverter and impeller section of the downhole vibration tool of FIG. 4 in a third position.

Referring to FIG. 4, a second embodiment of downhole vibration tool 100 is shown. The flow of drilling fluid through the downhole vibration tool 100 is shown by arrows. Downhole vibration tool 100 has a removable flow diverter 132 with a fluid passage 150 in communication with outer flow passage 113 and terminating in a flow control nozzle 148 in inner flow passage 115. In this embodiment, downhole vibration tool 100 has a stationary impeller 152, which may also be referred to as a flow conditioner, that has vanes 154 shaped to direct fluid flow around the inner portion 146. Fluid then travels to rotating impeller 122, where it strikes angled vanes 124, which causes rotating impeller 122 to rotate. By using an upper stationary impeller 152, the fluid flow can be conditioned to impinge in a direction that is closer to perpendicular than would otherwise be the case. Vanes 124 may be shaped to reduce vibrations due to flow restrictions between upper stationary impeller 152, such as by minimizing the cross-sectional area of the top of vanes 124 to minimize the flow restriction as the top of vanes 124 rotates past the bottom openings between vanes 154 of stationary impeller 152. Referring to FIG. 5 through 7, rotating impeller 122 may be provided upstream of flow restrictor 156, with stationary impeller 152 acting as a flow conditioner upstream of rotating impeller 122. Flow conditioner 152 has conditioning vanes 154 that are angled in a rotational direction opposite the vanes 124 of rotating impeller 122 to increase the angle of incidence of the fluid striking against rotating impeller vanes 124. At least one of conditioning vanes 154 and rotating impeller vanes 124 may be a composite angle, where the angle of the face of the vanes 124/154 increases as the fluid progresses down the tool. This may be used to increase the rotational component of the fluid flow without increasing turbulence. In addition, as can be seen, the thickness of the vanes may increase in progressing downstream to define the desired flow openings at the flow restrictor 156, which is discussed below.

Referring to FIG. 5, the stationary flow restrictor 156 is placed downstream of rotating impeller 122, and when vanes 124 of rotating impeller 122 align with vanes 158 of stationary flow restrictor 156, fluid is able to pass through stationary flow restriction 156. Referring to FIG. 6, as rotating impeller 122 rotates the flow area through stationary flow restrictor 156 is decreased, until fluid is blocked, or a minimum flow area is reached, as shown in FIG. 7. Fluid flow may be completely blocked, or a small amount of fluid may be permitted, which prevents the tool from becoming "stalled". Flow control nozzle 148 controls the flow rate through the impellers 122, 152, and 156 and can be sized for different drilling viscosities. Use of flow control nozzle 148 may allow for control over the percentage of drilling fluid that is diverted to travel through the impeller assembly. Preferably, a major portion of the drilling fluid will be forced through the impeller assembly. As fluid enters the impeller assembly, stationary impeller 152 diverts the flow through outer channel 113 to contact the channels of the rotating impeller 122 and causing impeller 122 to rotate. As rotating impeller 122 rotates the channels between vanes 154, the flow area between the channels in rotating impeller 122 and stationary flow restrictor 156 is reduced. When the flow is restricted, this will cause a pressure increase, and as the rotating impeller 122 turns further, the pressure will be released. These alternating pressure states create a pulsating action in the drill string, which in turn creates vibrations through the drill string and prevents sticking of the drill string against the walls of the well.

As shown, downstream of flow restrictor 156, flow channels 130 are provided that combine the inner and outer flow paths 113 and 115.

Figure 8:
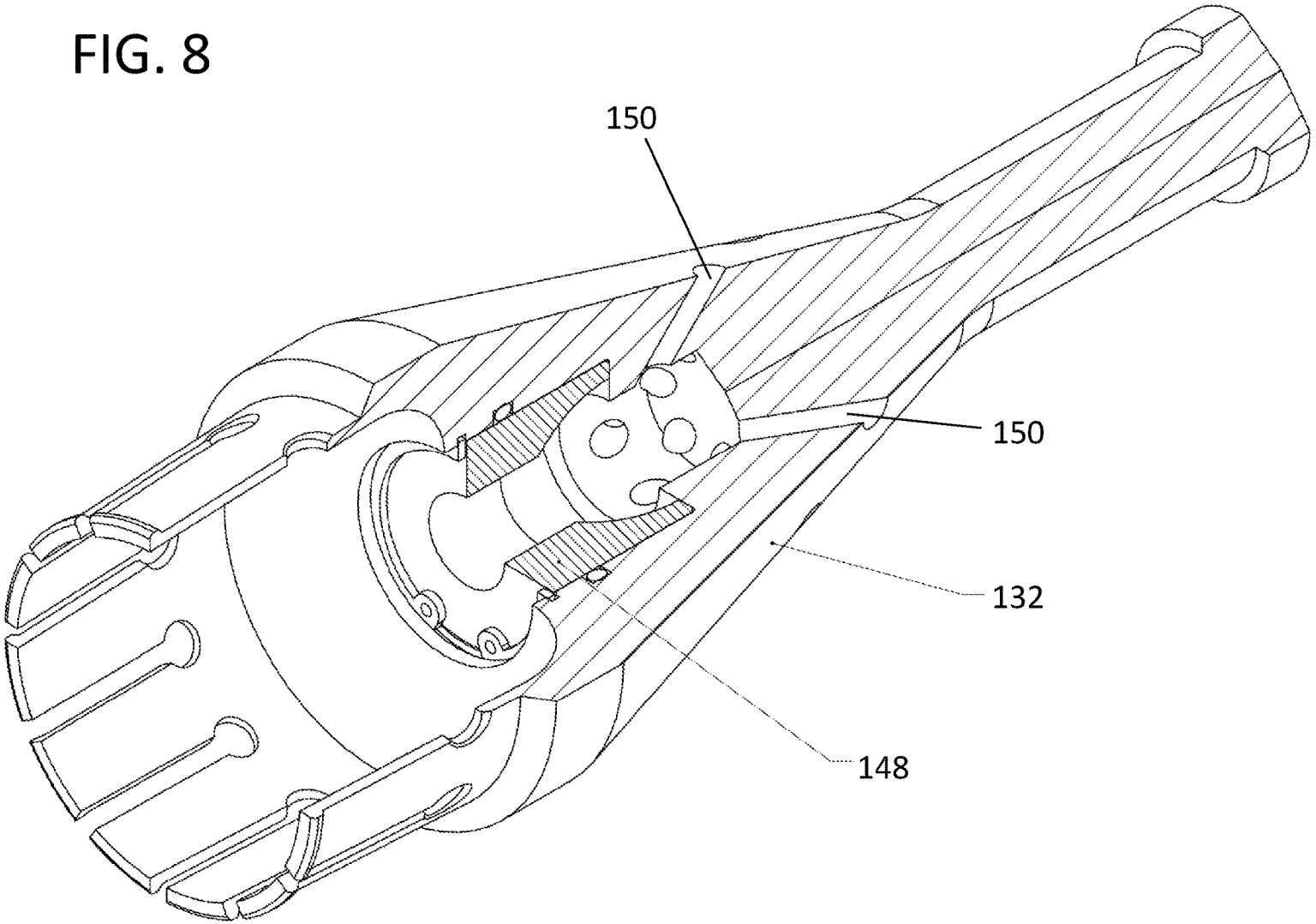
FIG. 8 is a perspective view in section of the flow diverter section of the downhole vibration tool of FIG. 4.

Referring to FIG. 8, interior details of flow diverter 132 are shown. By controlling the size of flow control nozzle 148 and accounting for the drilling fluid velocities, the volume of fluid passing through the impeller assembly can be controlled. This allows for the intensity of the pulses and the vibrations to be controlled by increasing or decreasing the proportions of fluid that are travelling through fluid passages 150 rather than through the impeller assembly. Flow diverter 132 may also be designed to be retrievable, and a tool may be run down the bore of the drill string to remove the flow diverter. This allows for tools being run below the downhole vibration tool 100 to be retrieved through the bore of the tool 100.

The above described downhole vibration tools 10 and 100 allow for a continuous axial vibration to be generated, as the rotating impeller 22/122 freely rotates under the influence of the drilling fluid. This vibration is of sufficient magnitude to be able to travel from downhole vibration tool 10 or 100 down the drill string to the drill bit. Vibration of the drill string aids in helping the drill string move, and may decrease the sticking of the tool and the restriction to movement in the well, particularly in horizontal sections of a well.

There may be additional examples and embodiments in addition to those herein above, as the features described above may be combined together in any reasonable combination as will be recognized by those skilled in the art.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A downhole vibration tool that permits tool retrieval therethrough, the downhole vibration tool comprising:

an outer housing having an inner bore and a longitudinal axis;

a rotating impeller that rotates within the inner bore of the outer housing, the rotating impeller defining an outer flow passage and an inner flow passage nested within the outer flow passage, the rotating impeller carrying impeller vanes that are angled relative to a rotational axis and that extend into the outer flow passage such that fluid passing through the outer flow passage impinges on the impeller vanes to cause the rotating impeller to rotate;

a flow restrictor having a variable flow area positioned in the outer flow passage and adjacent to the impeller vanes, the rotation of the impeller vanes causing the flow area of the flow restrictor to periodically increase and decrease; and a flow diverter having one or more flow restrictions in fluid communication with the inner flow passage and an outer surface in fluid communication with the outer flow passage, and the flow diverter being removably mounted to cover the inner bore of the outer housing.

2. The downhole vibration tool of claim 1, wherein the flow restrictor comprises a series of flow stops and openings that are radially distributed through the outer flow passage and immediately adjacent to the rotating impeller, the impeller vanes defining radially distributed rotating openings about the rotating impeller, and wherein the flow area increases and decreases as the rotating openings rotate across the openings of the flow restrictor.

3. The downhole vibration tool of claim 1, wherein the impeller vanes have a thickness in the radial direction and the flow stops of the flow restrictor have a thickness in the radial direction between openings, and where the variable flow area of the flow restrictor is varied as the thickness of the impeller vanes passes over the openings of the flow restrictor.

4. The downhole vibration tool of claim 1, wherein the flow restrictor comprises a stationary impeller having stationary impeller vanes, wherein the flow stops comprise a radial thickness of the stationary impeller vanes and the openings are formed between adjacent stationary impeller vanes.

5. The downhole vibration tool of claim 1, wherein the impeller vanes extend out from the rotating impeller toward the outer housing, and the rotating impeller comprises a tubular body having an outer surface, and an inner surface that defines the inner flow passage.

6. The downhole vibration tool of claim 5, wherein the outer flow passage is in fluid communication with the inner flow passage downstream of the flow restrictor.

7. The downhole vibration tool of claim 1, wherein the flow diverter is mounted to the rotating impeller.

8. The downhole vibration tool of claim 7, wherein the first end of the inner flow passage is opened by removing the flow diverter to allow the inner flow passage to act as a tool retrieval passage.

9. The downhole vibration tool of claim 1, wherein the rotating impeller is upstream of the flow restrictor, and further comprising a flow conditioner upstream of the rotating impeller, the flow conditioner comprising conditioning vanes that are angled in a rotational direction opposite the rotating impeller vanes to increase an angle of incidence of the fluid against the rotating impeller vanes.

10. The downhole vibration tool of claim 9, wherein the angle of at least one of the conditioning vanes and the rotating impeller vanes is a composite angle.

11. A downhole vibration tool that permits tool retrieval therethrough, the downhole vibration tool comprising:

an outer housing having an inner bore and a longitudinal axis;

a rotating impeller that rotates within the inner bore of the outer housing, the rotating impeller defining an outer flow passage and an inner flow passage nested within the outer flow passage, the rotating impeller carrying impeller vanes that are angled relative to a rotational axis and that extend into the outer flow passage such that fluid passing through the outer flow passage impinges on the impeller vanes to cause the rotating impeller to rotate;

a flow restrictor having a variable flow area positioned in the outer flow passage and adjacent to the impeller vanes, the rotation of the impeller vanes causing the flow area of the flow restrictor to periodically increase and decrease, wherein the rotating impeller is upstream of the flow restrictor; and a flow conditioner upstream of the rotating impeller, the flow conditioner comprising conditioning vanes that are angled hi a rotational direction opposite the rotating impeller vanes to increase an angle of incidence of the fluid against the rotating impeller vanes.

12. The downhole vibration tool of claim 11, further comprising a flow diverter having one or more flow restrictions in fluid communication with the inner flow passage and an outer surface in fluid communication with the outer flow passage, the flow diverter being removably mounted to cover the inner bore of the outer housing.

13. The downhole vibration tool of claim 12, wherein the flow restrictor comprises a series of flow stops and openings that are radially distributed through the outer flow passage and immediately adjacent to the rotating impeller, the impeller vanes defining radially distributed rotating openings about the rotating impeller, and wherein the flow area increases and decreases as the rotating openings rotate across the openings of the flow restrictor.

14. The downhole vibration tool of claim 12, wherein the impeller vanes have a thickness in the radial direction and the flow stops of the flow restrictor have a thickness in the radial direction between openings, and where the variable flow area of the flow restrictor is varied as the thickness of the impeller vanes passes over the openings of the flow restrictor.

15. The downhole vibration tool of claim 12, wherein the flow restrictor comprises a stationary impeller having stationary impeller vanes, wherein the flow stops comprise a radial thickness of the stationary impeller vanes and the openings are formed between adjacent stationary impeller vanes.

16. The downhole vibration tool of claim 12, wherein the flow diverter is mounted to the rotating impeller.

17. The downhole vibration tool of claim 16, wherein the first end of the inner flow passage is opened by removing the flow diverter to allow the inner flow passage to act as a tool retrieval passage.

18. The downhole vibration tool of claim 11, wherein the impeller vanes extend out from the rotating impeller toward the outer housing, and the rotating impeller comprises a tubular body having an outer surface, and an inner surface that defines the inner flow passage.

19. The downhole vibration tool of claim 18, wherein the outer flow passage is in fluid communication with the inner flow passage downstream of the flow restrictor.

20. The downhole vibration tool of claim 11, wherein the angle of at least one of the conditioning vanes and the rotating impeller vanes is a composite angle.

* * * * *